US009306330B2

(12) United States Patent
Kuroda

(10) Patent No.: US 9,306,330 B2
(45) Date of Patent: Apr. 5, 2016

(54) LEVER-TYPE CONNECTOR AND CONNECTOR ASSEMBLY

(71) Applicant: Sumitomo Wiring Systems, Ltd., Yokkaichi, Mie (JP)

(72) Inventor: Shinya Kuroda, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 14/263,505

(22) Filed: Apr. 28, 2014

(65) Prior Publication Data

US 2014/0322942 A1 Oct. 30, 2014

(30) Foreign Application Priority Data

Apr. 26, 2013 (JP) ..... 2013-093943

(51) Int. Cl.
*H01R 13/20* (2006.01)
*H01R 13/629* (2006.01)
*H01R 13/56* (2006.01)

(52) U.S. Cl.
CPC ..... *H01R 13/62938* (2013.01); *H01R 13/56* (2013.01)

(58) Field of Classification Search
CPC ..... H01R 13/56; H01R 13/62938
USPC ..... 439/157
See application file for complete search history.

(56) References Cited

U.S. PATENT DOCUMENTS

| | | | | | |
|---|---|---|---|---|---|
| 5,269,696 | A * | 12/1993 | Okada et al. | 439/140 |
| 5,328,377 | A * | 7/1994 | Saito | 439/157 |
| 5,395,258 | A * | 3/1995 | Okumura et al. | 439/157 |
| 5,427,539 | A * | 6/1995 | Saito | 439/157 |
| 5,441,420 | A * | 8/1995 | Okumura et al. | 439/157 |
| 2003/0162413 | A1 * | 8/2003 | Shinozaki et al. | 439/10 |
| 2006/0030186 | A1 * | 2/2006 | Toyoda et al. | 439/157 |

FOREIGN PATENT DOCUMENTS

| | | |
|---|---|---|
| JP | 2005-5135 | 1/2005 |
| JP | 2008-293723 | 12/2008 |

* cited by examiner

*Primary Examiner* — Abdullah Riyami
*Assistant Examiner* — Nelson R Burgos-Guntin
(74) *Attorney, Agent, or Firm* — Gerald E. Hespos; Michael J. Porco; Matthew T. Hespos

(57) ABSTRACT

A lever-type connector has a lever (30) rotatably supported on support shafts (22) on outer side surfaces of side walls (21) of a wire cover (20). Guide ribs (14) are formed on outer surfaces of a first housing (10) and extend parallel to an assembling direction of the wire cover (20). Guide grooves (24) are formed in inner surfaces of the side walls (21) and are engageable with the guide ribs (14). Two housing-side lock projections (16) on the outer surface of the first housing (10) and two cover-side lock projections (27) on the inner surface of the side wall (21) are arranged to be located respectively at opposite sides of the guide rib (14) and at opposite sides of the guide groove (24) in a direction substantially parallel to the side wall (21) and intersecting the assembling direction of the side wall (21).

10 Claims, 10 Drawing Sheets

LEVER-TYPE CONNECTOR AND CONNECTOR ASSEMBLY

BACKGROUND

1. Field of the Invention

The invention relates to a lever-type connector and to a connector assembly.

2. Description of the Related Art

Japanese Unexamined Patent Publication No. 2008-293723 discloses a lever-type connector configured so that a lock is formed on an outer side surface of a first housing and a hook is formed on an inner side surface of a side wall of a wire cover. The wire cover is assembled with the first housing to cover a wire draw-out surface of the first housing and is held in an assembled state by the engagement of the lock and the hook. A lever is supported rotatably on a support shaft formed on an outer side surface of the side wall of the wire cover. A cam groove of the lever and a cam follower of a second housing are engaged and the lever is rotated to connect the two housings by pulling them toward each other.

An operating portion of the lever is displaced in a direction intersecting an engaging direction of the lock and the hook and parallel to the side wall. An operating force applied to the operating portion acts on the wire cover via the support shaft and the side wall. As a result, the wire cover may be displaced substantially in the same direction as a displacing direction of the operating portion relative to the first housing and a locking margin between the lock and the hooking portion may be reduced.

Further, since the lever is supported on the support shaft formed on the outer side surface of the side wall of the wire cover, connection resistance between the two housings acts on the side wall via the engagement of the cam groove and the cam follower in the process of rotating the lever. As a result, the side wall may be displaced in a direction away from the outer side surface of the first housing and the locking margin between the lock and the hook may be reduced.

A countermeasure structure has considered forming a guide groove on the outer side surface of the first housing and extending parallel to the assembling direction of the wire cover. The guide groove would have a trapezoidal cross-section and would intersect a length direction. The countermeasure also would form a guide rib on the inner side surface of the side wall of the wire cover to extend parallel to the guide groove. The guide rib also would have a trapezoidal cross-section and would engage the guide groove. This countermeasure is intended to restrict displacement of the wire cover relative to the first housing in two-dimensional directions intersecting the length directions of the guide groove and the guide rib (i.e. a direction parallel to the side wall and a direction intersecting the side wall) to avoid reducing the locking margin between the lock projections.

However, when the lock projection of the wire cover moves over the lock projection of the first housing as the wire cover is assembled, a lock projection formation area of the side wall of the wire cover will displace resiliently out. However, an outward displacement of a guide rib formation area of the side wall is restricted by the engagement of the guide rib and the guide groove. Thus, the amount of resilient deflection of the side wall increases when the lock projections move over each other, and frictional resistance between the lock projections increases. If the frictional resistance between the lock projections increases, the assembling operability of the wire cover decreases. Therefore, an improvement is desired.

The invention was completed based on the above situation and aims to reduce frictional resistance between lock projections in the process of assembling a wire cover while potentially suppressing a resilient displacement of a side wall of the wire cover when a lever is operated.

SUMMARY OF THE INVENTION

The invention relates to a lever-type connector with a housing and housing-side lock projections are formed on an outer side surface of the housing. The connector also has a wire cover to be assembled with the housing from a wire draw-out surface of the housing. Cover-side lock projections are formed on an inner side surface of a side wall of the wire cover and are configured to lock the housing and the wire cover in an assembled state by being engaged with the housing-side lock projections. A lever is supported movably on the side wall and is configured to display a cam action to assist the connection of the housing with a mating housing of a mating connector. At least one guide rib is formed on the outer side surface of the housing and extends substantially parallel to the assembling direction of the wire cover. The guide rib has a trapezoidal or undercut cross-sectional shape intersecting with a length direction. At least one guide groove is formed in the inner side surface of the side wall and extends substantially parallel to the guide rib. The guide groove has a trapezoidal or undercut cross-sectional shape to be engageable with the guide rib. Housing-side lock projections and cover-side lock projections are arranged in such a positional relationship to be located respectively adjacent to the guide rib and the guide groove.

Two of the housing-side lock projections and two of the cover-side lock projections preferably are arranged to be located respectively at opposite sides of the guide rib and at opposite sides of the guide groove in a direction substantially parallel to the side wall and intersecting with the assembling direction of the wire cover.

A support shaft preferably is formed on an outer side surface of the side wall and the lever is supported rotatably on the support shaft. The lever preferably includes an operating portion displaceable in a direction substantially parallel to the side wall and intersecting with an assembling direction of the wire cover.

A tapered guiding portion preferably is formed on a tip side of the guide rib first reached by the wire cover being assembled in the assembling direction and a width in a direction intersecting the assembling direction of the wire cover is gradually reduced toward a tip.

The invention also relates to a connector assembly comprising the above-described lever-type connector and a mating connector having a mating housing including a mating cam member engageable with a cam member formed in the lever. The housing and the mating housing are pulled toward each other to be connected by a force multiplying action of the engagement of the mating cam member and the cam member when the lever is displaced.

These and other objects, features and advantages of the invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENT

Figure 1:
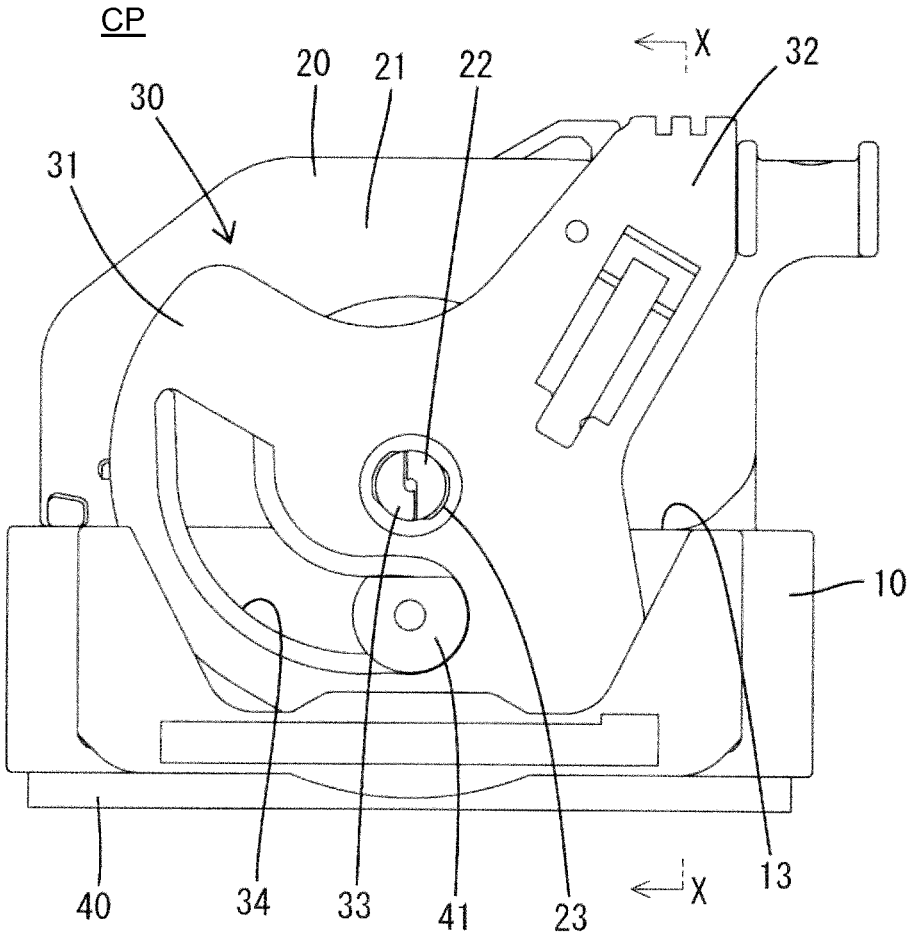
FIG. 1 is a side view showing a state where a first housing and a second housing are connected in a lever-type connector of one embodiment.
Figure 2:
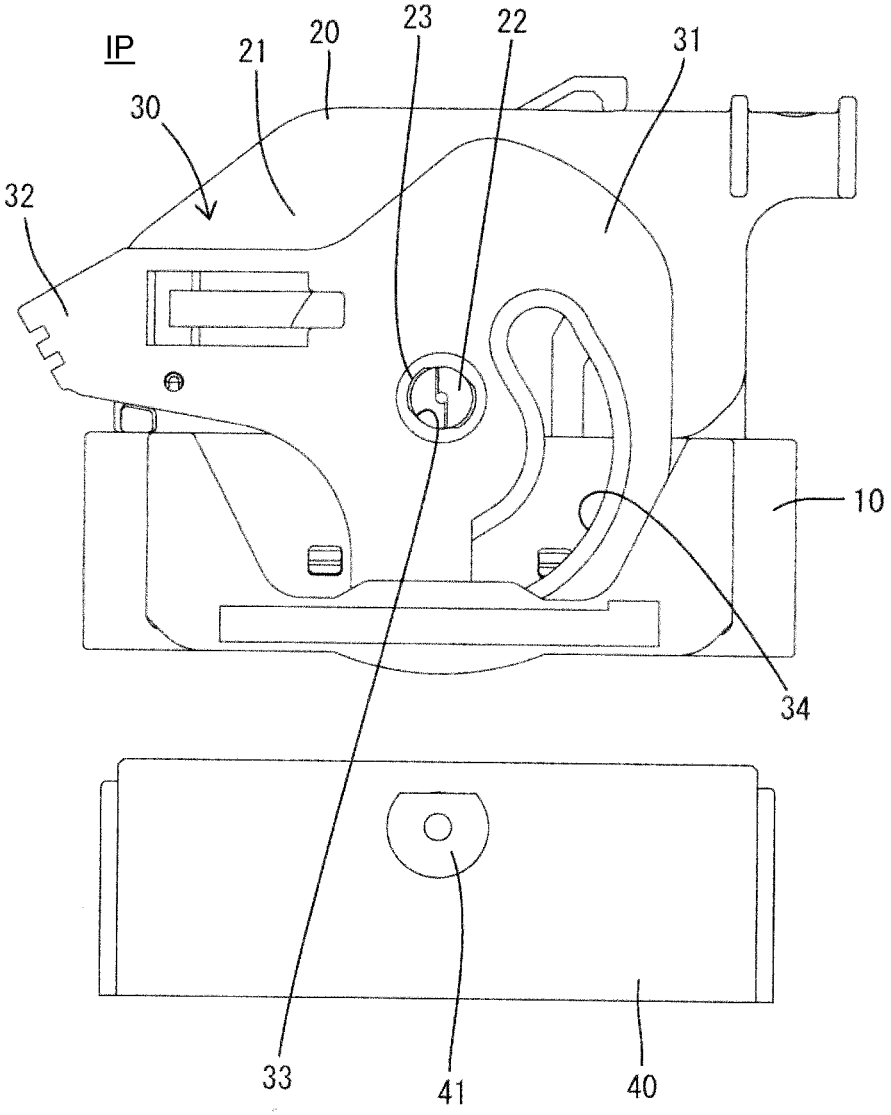
FIG. 2 is a side view showing a state before the first and second housings are connected.

A lever-type connector assembly includes a first housing 10, a wire cover 20, a lever 30 and a second housing 40, as shown in FIG. 2. In the following description, a vertical direction is based on that shown in FIG. 1. Concerning a front-back direction, a left side in FIGS. 1 to 4 is defined to be a front side. Further, a lateral direction is based on that shown in FIGS. 5 and 6 and a surface shown in FIG. 1 is defined to be a left surface.

Figure 3:
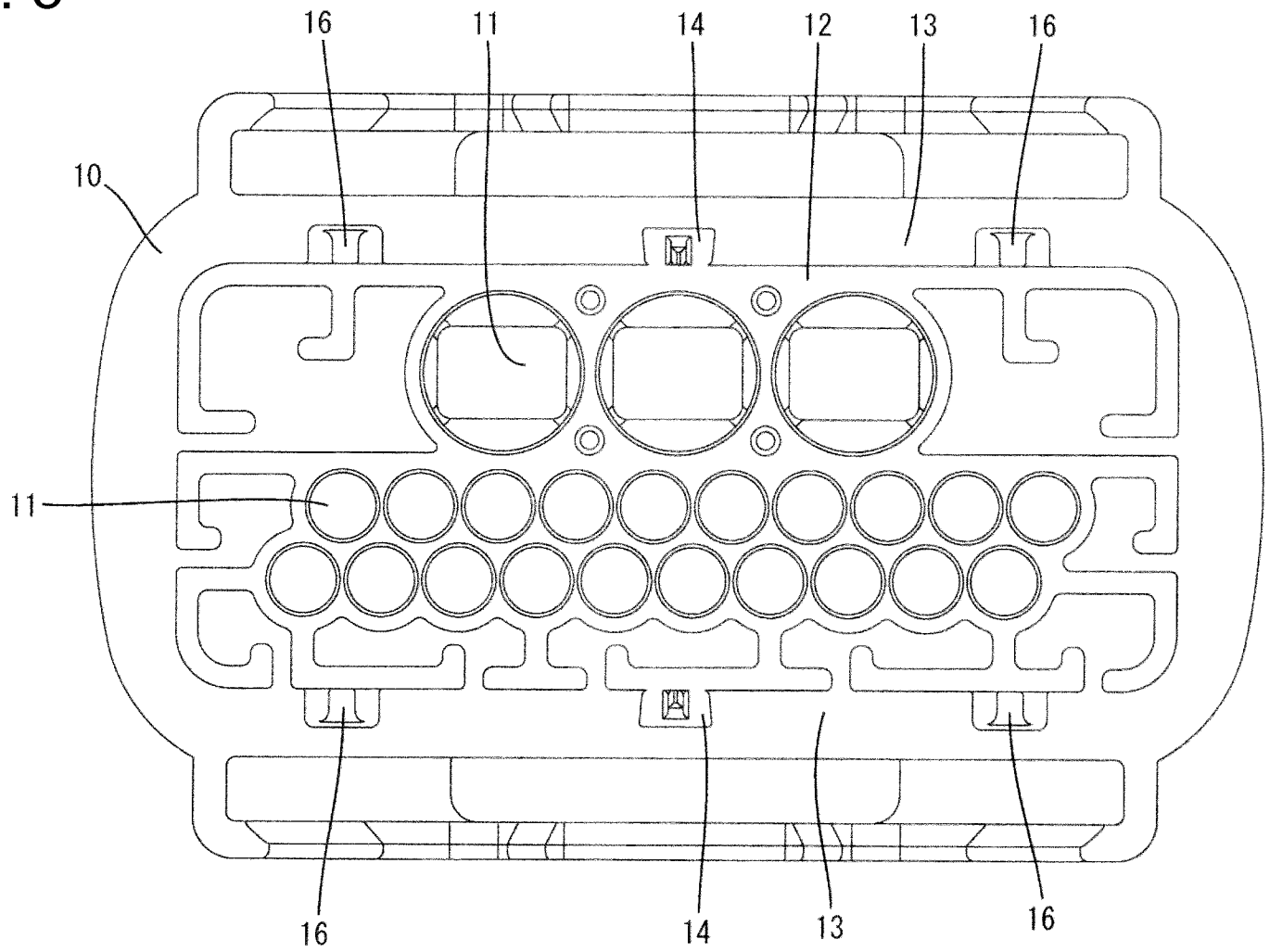
FIG. 3 is a plan view of the first housing.
Figure 5:
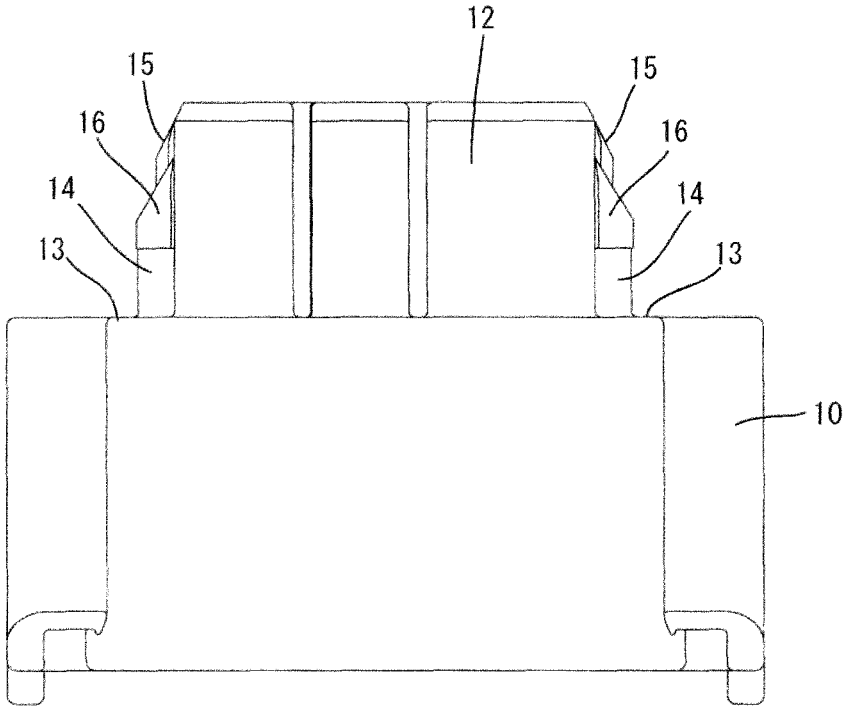
FIG. 5 is a rear view of the first housing.
Figure 8:
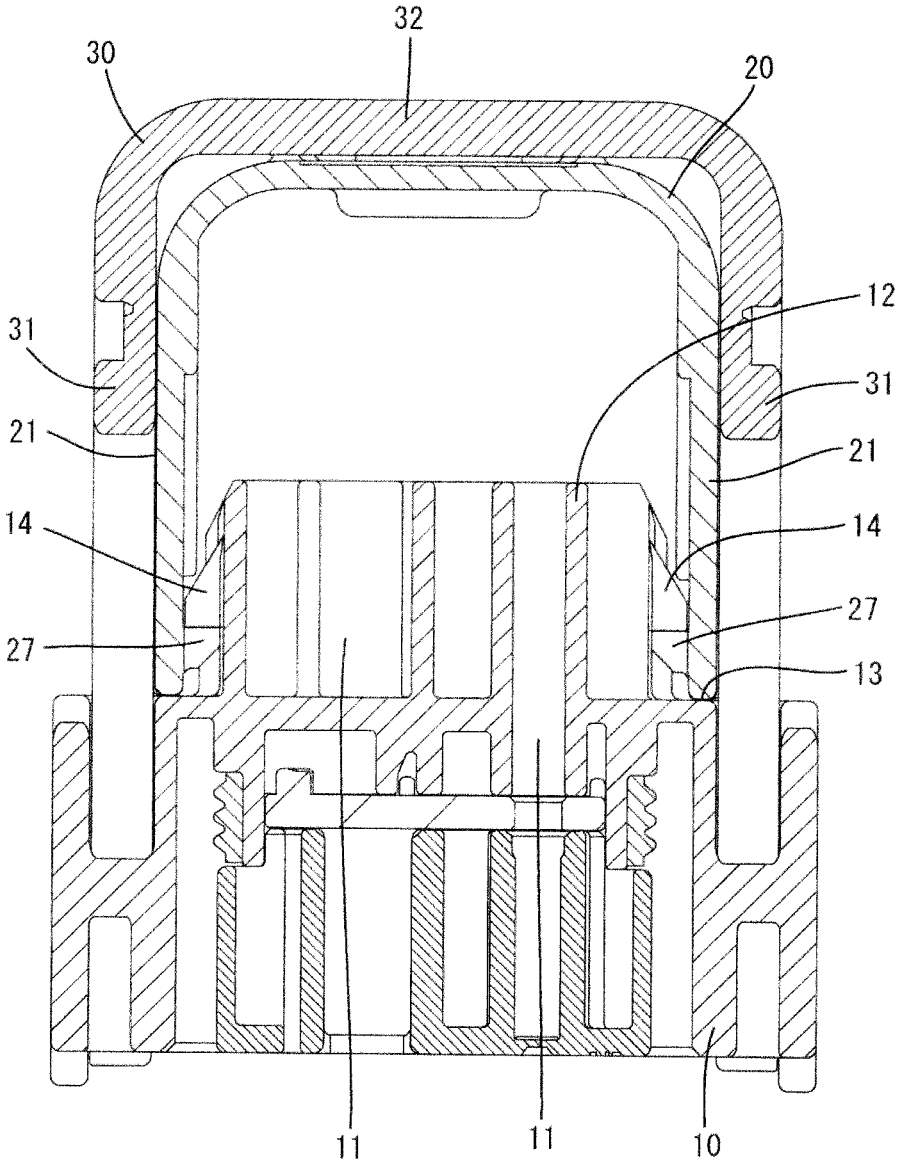
FIG. 8 is a section along X-X of FIG. 1.

The first housing 10 is made e.g. of synthetic resin. As shown in FIGS. 3 and 8, terminal accommodating chambers 11 penetrate the first housing 10 vertically, and a first terminal fitting (not shown) is to be inserted into each terminal accommodating chamber 11 from above. Wires (not shown) connected to the first terminal fittings are drawn out upward from the upper or wire draw-out surface of the first housing 10. As shown in FIGS. 3 and 5, a narrow portion 12 is formed in an upper area of the first housing 10 above a substantially central height in the vertical direction and has a reduced width to form a step. Left and right upwardly facing supporting surfaces 13 are formed on step-like areas of the first housing 10 extending along the lower end of the narrow portion 12.

Figure 4:
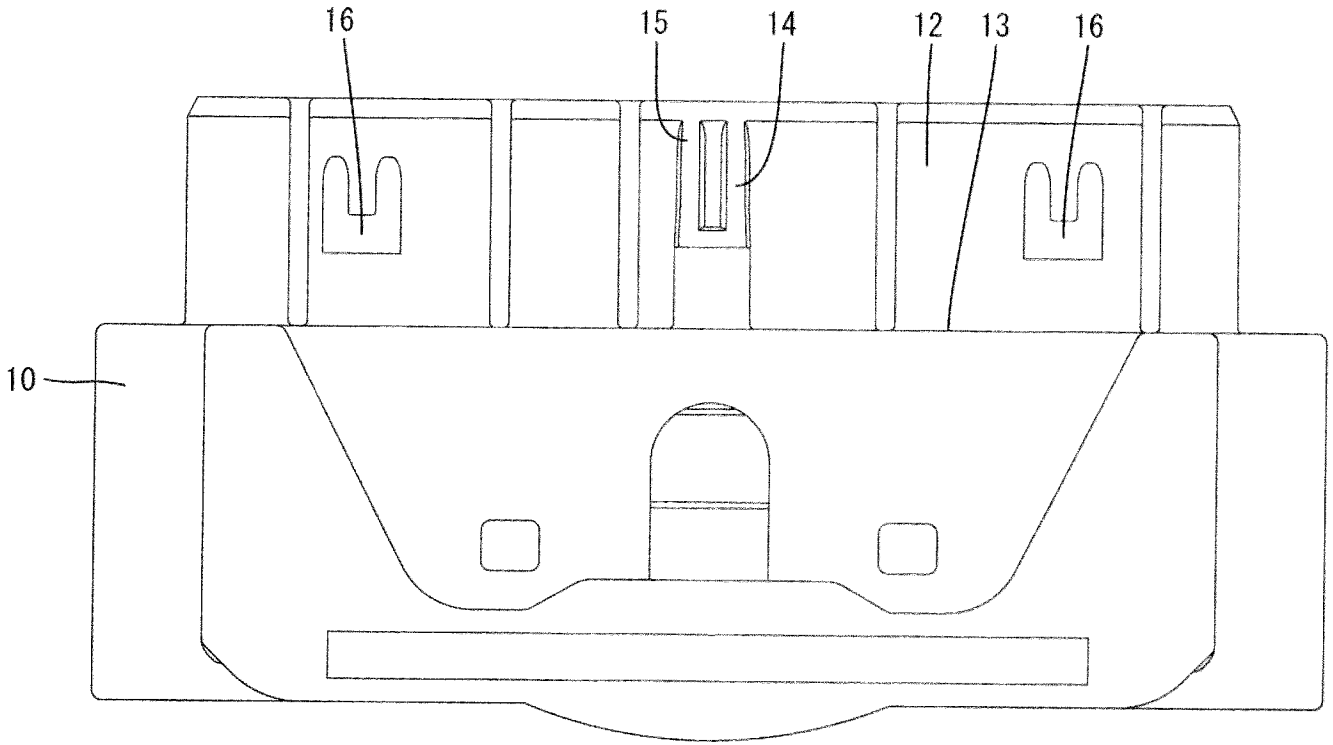
FIG. 4 is a side view of the first housing.

As shown in FIGS. 3 and 4, left and right guide ribs 14 project from opposite left and right outer surfaces of the narrow portion 12. The guide ribs 14 are arranged substantially at a substantially a central position of the first housing 10 in the front-back direction. The guide ribs 14 extend straight in the vertical direction (i.e. substantially parallel to an assembling direction of the wire cover 20 with the first housing 10). A formation area of the guide rib 14 in the vertical direction is from the upper end of the first housing 10 to the lower end of the narrow portion 12 (supporting surfaces 13). Further, as shown in FIG. 4, a tapered guide 15 is formed on an upper end of the guide rib 14 and has a width in the front-back direction that is gradually reduced toward the top.

Figure 9:
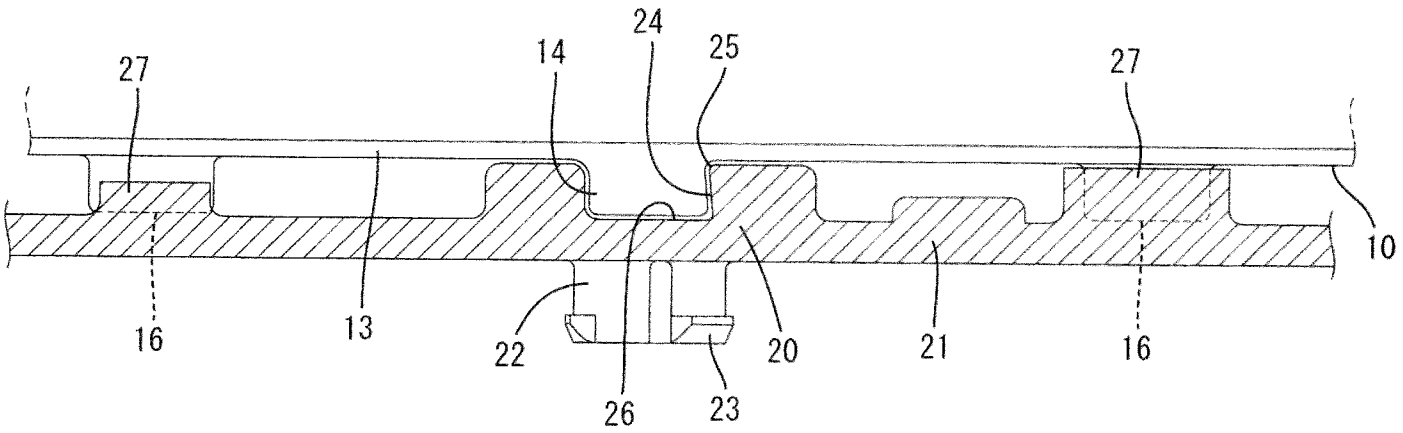
FIG. 9 is a sectional view showing a state before cover-side lock projections interfere with housing-side lock projections in the process of assembling the wire cover with the first housing.
Figure 10:
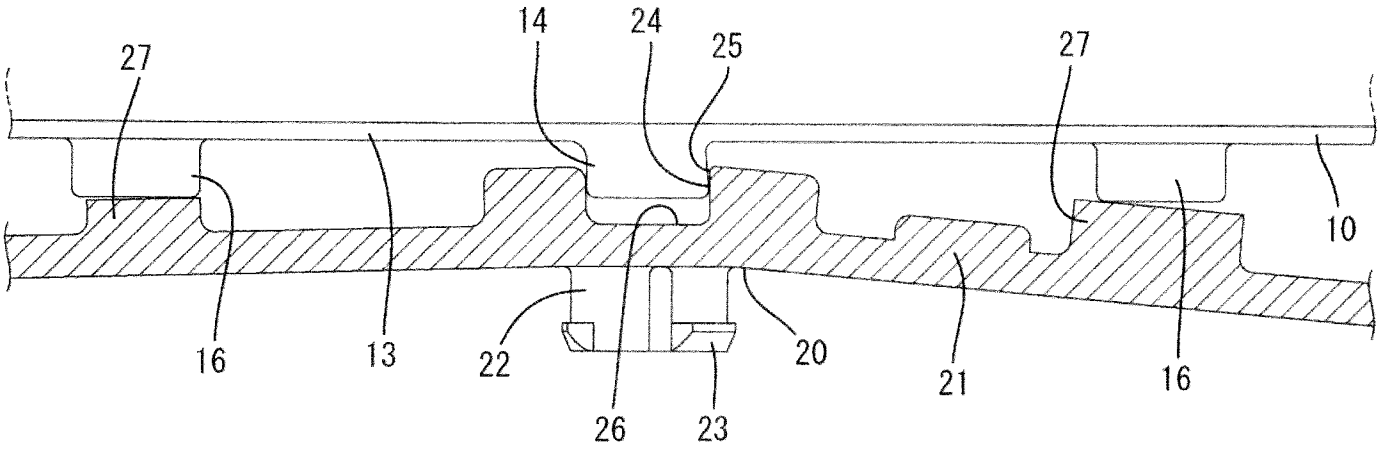
FIG. 10 is a plan view in section showing a state where a side wall portion of the wire cover is deformed due to the interference of the cover-side lock projections and the housing-side lock projections when assembling the wire cover with the first housing.

As shown in FIGS. 3, 9 and 10, a cross-sectional shape of the guide rib 14 perpendicular to a length direction is substantially trapezoidal. Specifically, opposite end parts of the guide rib 14 in the lateral direction are configured so that a dimension of an inner end part connected to the narrow portion 12 in the front-back direction is smaller than that of an outer end part opposite to the narrow portion 12 in the front-back direction.

Front and rear housing-side lock projections 16 project from the opposite left and right outer surfaces of the narrow portion 12. The housing-side lock projections 16 are at opposite front and rear sides of the guide rib 14 in the front-back direction. A distance from the guide rib 14 to the front housing-side lock projection 16 and that from the guide rib 14 to the rear housing-side lock projection 16 are substantially equal.

Figure 6:
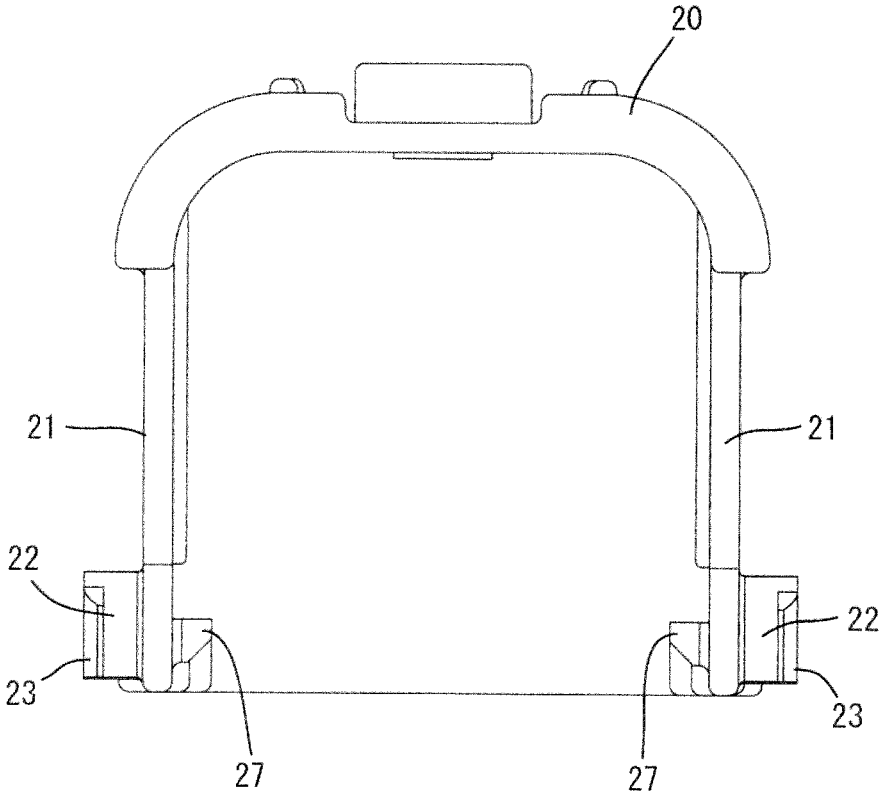
FIG. 6 is a rear view of a wire cover.
Figure 7:
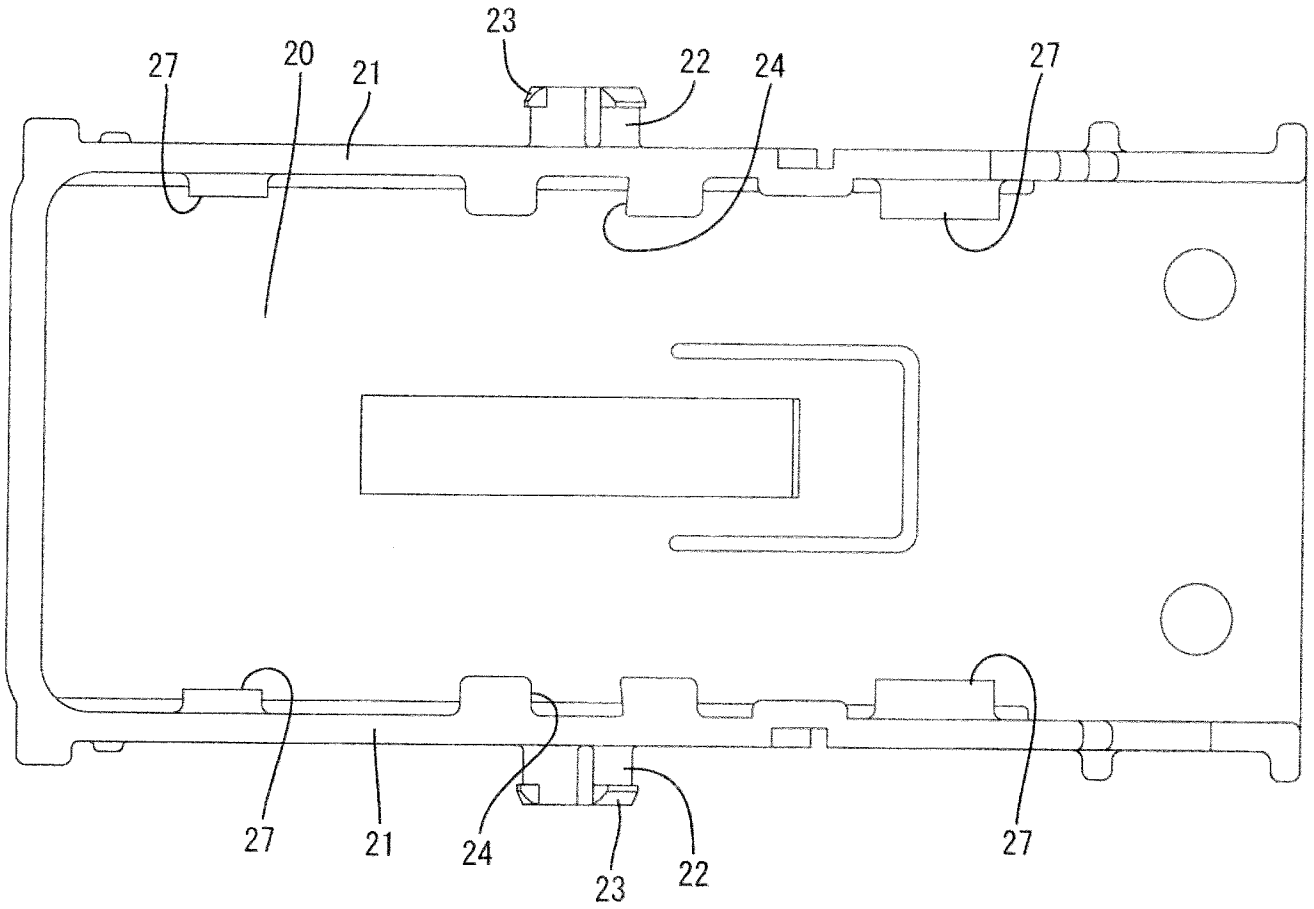
FIG. 7 is a bottom view of the wire cover.

The wire cover 20 is made e.g. of synthetic resin. As shown in FIGS. 1, 2 and 8, the wire cover 20 is assembled with the first housing 10 to at least partly cover the wire draw-out surface of the first housing 10. Wires (not shown) drawn out from the draw-out surface from the wire cover 20 are bent in the wire cover 20 and drawn out to a rear outer side of the wire cover 20. As shown in FIG. 8, the wire cover 20 includes substantially bilaterally symmetric side walls 21 arranged to conceal the outer side surfaces of the narrow portion 12 when assembled with the first housing 10. As shown in FIGS. 6 and 7, two coaxial support shafts 22 project from the outer side surfaces of the left and right side walls 21. The support shafts 22 are at a central position of the wire cover 20 in the front-back direction. Thus, the guide ribs 14 and the support shafts 22 are arranged substantially at the same position in the front-back direction.

As shown in FIGS. 7, 9 and 10, two substantially bilaterally symmetric guide grooves 24 are formed by recessing the inner side surfaces of the left and right side walls 21 of the wire cover 20. The guide grooves 24 are arranged at substantially the same position as the guide ribs 14 and the support shafts 22 in the front-back direction. The guide grooves 24 extend substantially straight in the vertical direction similar to the guide ribs 14. Further, cross-sectional shapes of the guide grooves 24 perpendicular to the length direction are trapezoidal similar to the guide ribs 14. That is, the guide grooves 24 are dovetail or undercut grooves. As shown in FIGS. 9 and 10, a width of an opening 25 of the guide groove 24 in the inner side surface of the side wall 21 is smaller than a width of a groove bottom surface 26 of the guide groove 24 in the front-back direction.

The guide ribs 14 engage the guide grooves 24 so that the wire cover 20 is assembled smoothly with the first housing 10 while positioned in two directions (i.e. front-back direction and lateral direction) perpendicular to the assembling direction. Further, the engagement of the guide grooves 24 and the guide ribs 14 prevent the side walls 21 from being displaced out a large amount in directions away from the outer side surfaces of the narrow portion 12.

As shown in FIGS. 6 to 8, front and rear cover-side lock projections 27 project from the inner side surface of each of the left and right side walls 21 of the wire cover 20. As shown in FIGS. 7, 9 and 10, the front and rear cover-side lock projections 27 are at opposite front and rear sides of the guide groove 24 in the front-back direction and are at positions substantially corresponding to the housing-side lock projections 16 in the front-back direction. As shown in FIG. 8, the side walls 21 are substantially in contact with the supporting surfaces 13 from above and the cover-side lock projections 27 are engaged with the housing-side lock projections 16 from below when the wire cover 20 is assembled correctly with the first housing 10. Thus, the wire cover 20 is locked in a state where relative vertical displacement with respect to the first housing 10 is prevented.

The lever 30 is made unitarily of synthetic resin. As shown in FIG. 8, the lever 30 and has left and right substantially plate-like arms 31 and an operating portion 32 connecting the arms 31. Each arm 31 is formed with a bearing hole 33 to be engaged with the support shaft 22 so that the lever 30 is rotatable about the support shafts 22 between the initial position IP (see FIG. 2) and the connection position CP (see FIG. 1). The lever 30 mounted on the support shafts 22 is prevented from being separated out in the lateral direction from the support shafts 22 by a locking action of large-diameter portions 23 formed on projecting ends of the support shafts 22. Further, as shown in FIGS. 1 and 2, each arm 31 has a cam groove 34 substantially surrounding the bearing hole 33.

The second housing 40 is made e.g. of synthetic resin and second terminal fittings (not shown) are accommodated inside. As shown in FIG. 2, cam followers 41 project from left and right outer side surfaces of the second housing 40. In connecting the first and second housings 10, 40, the cam followers 41 are caused to enter the entrances of the cam grooves 34 by lightly fitting the two housings 10, 40 in a state where the lever 30 is held on standby at the initial position IP. The lever 30 then is rotated from the initial position IP to the connection position CP by gripping the operating portion 32. As a result, the housings 10, 40 are pulled toward each other and connected as shown in FIG. 1 by a force multiplying action of the engaged cam grooves 34 and cam followers 41.

The operating portion 32 is displaced along an arcuate path while rotating the lever 30 between the initial position IP and the connection position CP. During this time, the operating portion 32 is displaced substantially in the front-back direction in an area near the connection position CP. The displacement of the operating portion 32 in the front-back direction substantially perpendicular to a connecting direction of the two housings 10, 40 creates an external force to urge the wire cover 20 that supports the lever 30 and the first housing 10 fit to the second housing 40 in the front-back direction. However, the contact of the guide grooves 24 of the wire cover 20 and the guide ribs 14 of the first housing 10 prevents relative displacement of the wire cover 20 and the first housing 10 in the front-back direction.

Further, forces caused by the engagement of the cam grooves 34 and the cam followers 41 in the process of rotating the lever 30 act to separate the arms 31 out in the lateral direction from the side walls 21 of the wire cover 20. The forces acting on the arms 31 are transmitted to the side walls 21 of the wire cover 20 via the large-diameter portions 23 and the support shafts 22. Thus, the side walls 21 receive external forces in directions to separate out in the lateral direction from the outer side surfaces of the narrow portion 12 of the first housing 10. However, the engagement of the trapezoidally-shaped guide grooves 24 in the side walls 21 and the trapezoidally-shaped guide ribs 14 on the narrow portion 12 prevent displacements of the side walls 21 in the directions to separate from the outer sides of the narrow portion 12 of the first housing 10.

As described above, the engagement of the trapezoidally-shaped guide grooves 24 in the side walls 21 and the trapezoidally-shaped guide ribs 14 on the narrow portion 12 prevent displacements of the wire cover 20 relative to the first housing 10. Thus, locking margins between the housing-side lock projections 16 and the cover-side lock projections 27 are not reduced.

However, the engagement of the trapezoidally-shaped guide grooves 24 in the side walls 21 and the trapezoidally-shaped guide ribs 14 on the narrow portion 12 may create a new problem. Specifically, the cover-side lock projections 27 move over the housing-side lock projections 16 as the wire cover 20 is assembled. Thus, areas of the side walls 21 where the cover-side lock projections 27 are formed are going to displace resiliently out. However, the engagement of the guide ribs 14 and the guide grooves 24 prevent areas of the side walls 21 that have the guide ribs 14 from displacing out. Thus, when the cover-side lock projections 27 move over the housing-side lock projections 16, the amount of resilient deflection of the side wall portions 21 increases to increase frictional resistance between the lock projections 16, 27. An increase in the frictional resistance between the lock projections 16, 27 means a reduction in the assembling operability of the wire cover 20.

Accordingly, two housing-side lock projections 16 and two cover-side lock projections 27 are located close to the guide rib 14 and/or the guide groove 24, and preferably at substantially opposite sides of the guide rib 14 and at substantially opposite sides of the guide groove 24 in the front-back direction. Thus, frictional resistance between the lock projections 16, 27 in the process of assembling the wire cover 20 with the first housing 10 is reduced while resilient displacements of the side walls 21 of the wire cover 20 when the lever 30 is rotated is suppressed.

With the above-described arrangement, the areas of the side wall 21 where the cover-side lock projections 27 are formed displace resiliently out during assembly of the wire cover 20 and the side wall 21 deforms resiliently so that the inner surface side thereof expands inward (up in FIG. 10) as the front and rear cover-side lock projections 27 move over the front and rear housing-side lock projections 16 at the opposite sides of the guide groove 24, as shown in FIG. 10. At this time, the guide groove 24 formed in the inner surface of the side wall 21 is deformed to widen the opening 25 of the guide groove 24 if the side wall 21 is deformed resiliently so that the inner surface side thereof expands.

An interval between the front and rear inner surfaces of the guide groove 24 is widened if the opening width of the guide groove 24 is widened. Thus, the area of the side wall 21 where the guide groove 24 is formed is displaced out relative to the guide rib 14 of the first housing 10. That is, the groove bottom surface 26 of the guide groove 24 is separated from the outer side surface of the guide rib 14. In this way, differences between lateral displacements of the areas of the side wall 21 where the cover-side lock projections 27 are formed relative to the first housing 10 and a lateral displacement of the area of the side wall 21 where the guide groove 24 is formed relative to the first housing 10 become smaller. Therefore the amount of resilient deflection of the side wall 21 is suppressed by that much.

Resilient restoring forces of the side wall 21 become smaller by suppressing the amount of resilient deflection of the side wall 21. Thus, frictional resistance between the housing-side lock projections 16 and the cover-side lock projections 27 due to the resilient restoring force of the side wall 21 is reduced. Accordingly, the lever-type connector exhibits excellent operability in assembling the wire cover 20 with the first housing 10.

Further, the guiding portion 15 is formed on the upper end part of each guide rib 14. As shown in FIG. 4, this guiding portion 15 has a tapered shape whose width in the front-back direction intersecting with the assembling direction of the wire cover 20 is gradually reduced toward the tip (upper or distal end). Thus, if it is attempted to assemble the wire cover 20 in a state displaced in the front-back direction from the first housing 10, a displacement of the wire cover 20 relative to the first housing 10 is corrected by the tapered guiding portions 15 when the engagement of the guide grooves 24 with the guide ribs 14 is started.

The invention is not limited to the above described embodiment. For example, the following embodiment also are included in the scope of the present invention.

The tapered guiding portions are formed on the tip sides of the guide ribs first reached by the wire cover being assembled in the assembling direction in the above embodiment, such guiding portions may not be formed.

The cross-sectional shape (plan view shape) of the guide rib 14 perpendicular to a length direction (vertical direction)

in the above embodiment is substantially trapezoidal. However, other configurations or cross-sections (such as a substantially mushroom-shaped or substantially hook-shaped undercut configuration) that allow an interlocking with the substantially complementary undercut/cooperating configuration or cross-sectional shape of the guide groove may be provided.

What is claimed is:

1. A lever-type connector, comprising:

a housing with a mating end that is connectable to a mating connector along a connecting direction, a wire draw-out surface opposite the mating end and outer side surfaces extending between the mating end and the wire draw-out surface;

housing-side lock projections formed on the outer side surfaces of the housing;

a wire cover assembled with the housing along an assembling direction that is substantially parallel to the connecting direction and covering at least parts of the wire draw-out surface and the side surfaces of the housing;

cover-side lock projections formed on inner side surfaces of side walls of the wire cover and configured to lock the housing and the wire cover in an assembled state by engaging with the housing-side lock projections;

a lever movably supported on the side walls of the cover and configured to display a cam action to assist connection of the housing with the mating housing of a mating connector;

at least one guide rib formed on at least one of the outer side surfaces of the housing, extending substantially parallel to the assembling direction of the wire cover and having an undercut cross-sectional shape intersecting a length direction; and at least one guide groove formed in the inner side surface of the side wall of the cover, extending substantially parallel to the guide rib and having an undercut cross-sectional shape to be engageable with the guide rib;

the housing-side lock projections and the cover-side lock projections being arranged in such a positional relationship as to be respectively located adjacent to the guide rib and the guide groove engaged therewith so that the undercut cross-sectional shapes of the engaged guide rib and guide groove keep the housing-side lock projections locked to the cover-side lock projections.

2. The lever-type connector of claim 1, wherein a pair of the housing-side lock projections and a pair of the cover-side lock projections are arranged in such a positional relationship as to be respectively located at substantially opposite sides of the guide rib and at opposite sides of the guide groove in a direction substantially parallel to the side wall and intersecting with the assembling direction of the wire cover.

3. The lever-type connector of claim 1, further comprising a support shaft formed on an outer side surface of the side wall of the wire cover;

the lever being supported rotatably on the support shaft and including an operating portion displaceable in a direction substantially parallel to the side wall and intersecting with an assembling direction of the wire cover.

4. The lever-type connector of claim 1, wherein a tapered guiding portion is formed on a tip side of the guide rib first reached by the wire cover being assembled in the assembling direction and having a width in a direction intersecting the assembling direction of the wire cover gradually reduced toward a tip.

5. A connector assembly comprising the lever-type connector of claim 1 and a mating connector having a mating housing including a mating cam member engageable with a cam member formed in the lever, the housing and the mating housing being pulled toward each other to be connected by a force multiplying action of the engagement of the mating cam member and the cam member when the lever is displaced.

6. A lever-type connector, comprising:

a housing with a mating end that is connectable to a mating connector along a connecting direction, a wire draw-out surface opposite the mating end, and first and second opposite outer side surfaces extending between the mating end and the wire draw-out surface, first and second housing-side locks formed respectively on the first and second outer side surfaces of the housing, first and second undercut housing-side guides formed respectively on the first and second outer side surfaces of the housing in proximity to the respective housing-side locks, the housing-side guides being elongate and extending substantially parallel to the connecting direction;

a wire cover covering at least parts of the wire draw-out surface of the housing and having opposite first and second side walls assembled respectively with the first and second side walls of the housing, first and second cover-side locks formed on inner side surfaces of the respective first and second side walls of the wire cover and engaged respectively with the first and second housing-side locks, and first and second undercut cover-side guides formed on the inner side surfaces of the respective first and second side walls of the cover, the first and second cover-side guides being engaged respectively with the first and second housing-side guides; and a substantially U-shaped lever having first and second arms rotatably supported on the respective first and second side walls of the cover and configured to display a cam action to assist connecting the housing with the mating connector.

7. The lever-type connector of claim 6, wherein the housing-side guides are ribs and the cover-side guides are grooves.

8. The lever-type connector of claim 7, wherein the ribs are narrow adjacent the side surfaces of the housing and widen at further distances from the side surfaces of the housing.

9. The lever-type connector of claim 8, wherein the grooves are narrow adjacent the inner side surfaces of the side walls of the wire cover and widen at further distances into the side walls of the wire cover.

10. The lever-type connector of claim 6, wherein each of the side surfaces of the housing has two of the housing side locks disposed on opposite sides of the respective guide rib and wherein each of the side walls of the cover has two of the cover-side locks engaged respectively with the housing side locks.

* * * * *